US005193364A

United States Patent [19]

Leenders

[11] Patent Number: 5,193,364

[45] Date of Patent: Mar. 16, 1993

[54] CHAMOIS WRINGER

[76] Inventor: Russell A. Leenders, P.O. Box 84174, Lincoln, Nebr. 68501

[21] Appl. No.: 843,803

[22] Filed: Feb. 28, 1992

[51] Int. Cl.[5] ..... D06F 45/10

[52] U.S. Cl. ..... 68/248; 68/256; 68/273; 100/155 R; 15/262

[58] Field of Search ..... 100/233, 168, 176, 155 R; 68/244, 248, 256, 273; 15/97.3, 262

[56] References Cited

U.S. PATENT DOCUMENTS

| | | | |
|---|---|---|---|
| 60,102 | 11/1866 | White | 15/262 |
| 870,463 | 11/1907 | Pettibone | 15/262 |
| 874,240 | 12/1907 | Reed | 15/262 |
| 969,952 | 9/1910 | Harris | 68/245 |
| 1,015,450 | 1/1912 | McCloskey | 15/262 |
| 1,177,623 | 4/1916 | Henderson | 15/262 |
| 1,673,473 | 6/1928 | Sands | 15/262 |
| 1,700,071 | 1/1929 | Overaker | 15/262 |
| 2,677,951 | 5/1954 | Haines et al. | 68/245 |
| 2,724,848 | 11/1955 | Horvath | 15/262 X |

FOREIGN PATENT DOCUMENTS

| | | | |
|---|---|---|---|
| 632296 | 11/1949 | United Kingdom | 15/262 |
| 2036549 | 7/1980 | United Kingdom | 15/262 |

*Primary Examiner*—Frankie L. Stinson
*Attorney, Agent, or Firm*—Zarley McKee Thomte Voorhees & Sease

[57] ABSTRACT

A chamois wringer includes a base plate with an arm pivotally connected thereto. A first roller is mounted on the base plate, and a second roller is mounted on the pivotable arm such that pivoting of the arm will bring the second roller into rolling contact with the first roller. A chamois threaded between the rollers will be placed under compression as it is pulled between the rollers, to remove excess water from the chamois.

4 Claims, 3 Drawing Sheets

CHAMOIS WRINGER

TECHNICAL FIELD

The present invention relates generally to apparatus for removing excess water from rags, and more particularly to an improved apparatus for removing water from a chamois.

BACKGROUND OF THE INVENTION

Since the advent of the motor vehicle, vehicle owners have spent much time in maintaining the clean shiny appearance of their vehicle. Part of this routine includes washing and waxing the exterior body.

In order to prevent the formation of water spots on the exterior surface of the vehicle, it is necessary to immediately wipe the surface dry, before water droplets can evaporate on the surface. One of the most effective materials utilized to absorb and remove water from the body surface is the soft pliant leather material commonly known as a chamois.

While a chamois is an effective material for removing and absorbing water, it is more difficult to more conveniently remove this excess water from the chamois, so that the chamois may again be utilized to dry the surface of the vehicle. Typically, the chamois must be twisted to manually wring the material dry, thereby causing water to drip and spray on the consumer. The manual wringing of the chamois is often not effective in removing water from the chamois, such that the chamois will not perform its drying function as well as before.

It is there a general object of the present invention to provide an improved apparatus for wringing a chamois.

Another object of the present invention is to provide an improved chamois wringer which applies great compressive force to the chamois to remove excess water.

Yet another object is to provide an improved chamois wringer which is portable, to permit easy use at a particular site.

Still another object of the present invention is to provide an improved chamois wringer which will operate either on the ground or hanging on a wall.

Still another object is to provide a chamois wringer which is simple to operate, economic to manufacture, and refined in appearance.

These and other objects will be apparent to those skilled in the art.

SUMMARY OF THE INVENTION

The chamois wringer of the present invention includes a base plate with an arm pivotally connected thereto. A first roller is mounted on the base plate, and a second roller is mounted on the pivotable arm such that pivoting of the arm will bring the second roller into rolling contact with the first roller. A chamois threaded between the rollers will be placed under compression as it is pulled between the rollers. Compressive force may be applied between the rollers by pressing on the pivotable arm.

DESCRIPTION OF THE PREFERRED EMBODIMENT

Figure 1:
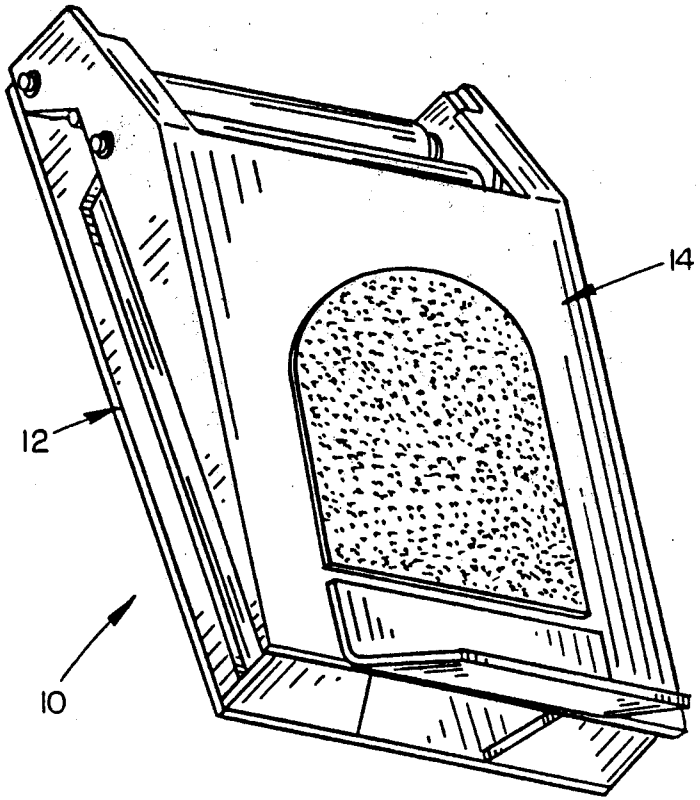
FIG. 1 is a perspective view of the present invention.

Referring now to the drawings, in which similar or corresponding parts are identified with the same reference numeral, and more particularly to FIG. 1, the chamois wringer of the present invention is designated generally at 10 and includes a base 12 with an arm 14 pivotally connected to base 12.

Figure 3:
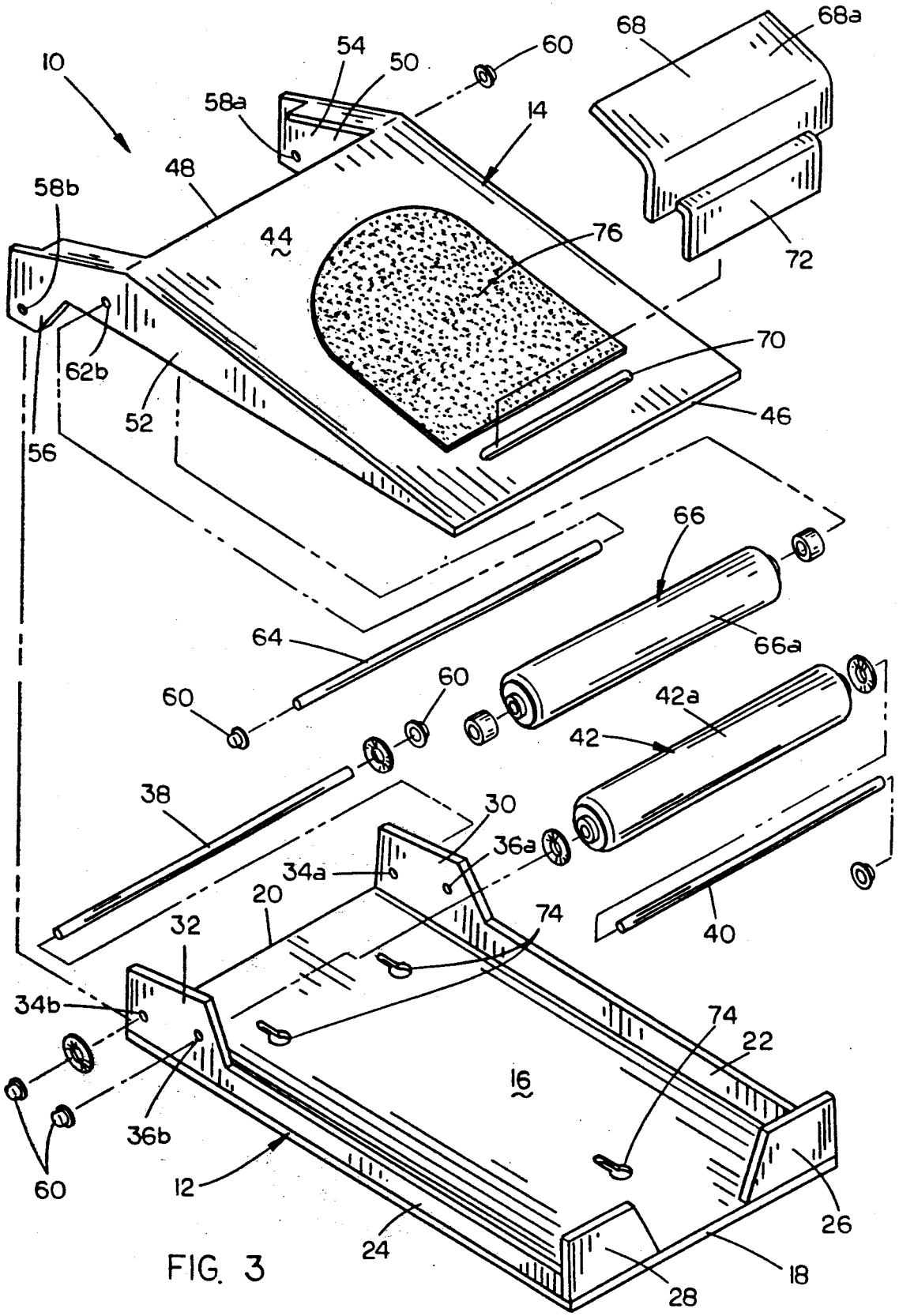
FIG. 3 is an exploded perspective view of the present invention.

Referring now to FIG. 3, base 12 includes a generally planar plate 16 having a forward end 18 and rearward end 20. A pair of longitudinal and opposing side walls 22 and 24 project upwardly from the sides of plate 16 and extend from forward end 18 to rearward end 20. A pair of spaced-apart and upwardly projecting feet 26 and 28 are mounted along the forward edge of plate 16 and extend upwardly beyond side walls 22 and 24 respectively. Feet 26 and 28 are spaced-apart a distance so as to permit a chamois to be pulled rearwardly across plate 16 between feet 26 and 28, as discussed in more detail hereinbelow.

The rearward end of side walls 22 and 24 have an upwardly projecting wing 30 and 32 respectively. Wing 30 includes a pair of apertures 34*a* and 36*a* therethrough. Wing 32 has a corresponding pair of apertures 34*b* and 36*b* formed therein aligned horizontally with apertures 34*a* and 36*a* respectively. Apertures 34*a* and 34*b* will receive a rod 38 therethrough for pivotally connecting arm 14 to base 12, as discussed in more detail hereinbelow. Apertures 36*a* and 36*b* will receive an axle 40 therethrough which is journaled through a roller 42, to rotatably mount roller 42 between wings 30 and 32.

Arm 14 includes an upper plate 44 having a forward end 46, rearward end 48, and a pair of depending longitudinal side walls 50 and 52. Side walls 50 and 52 project rearwardly beyond the rearward end 48 of plate 44 to form legs 54 and 56 respectively. Legs 54 and 56 have corresponding and coaxially aligned apertures 58*a* and 58*b* formed therethrough, which correspond with apertures 34*a* and 34*b* to receive rod 38 therethrough. Thus, rod 38 acts as the pivotal connection between arm 14 and base 12. Press-on caps 60 maintain rod 38 in position, pivotally connecting arm 14 to base 12.

A pair of apertures 62*a* (not shown) and 62*b* are formed in depending side walls 50 and 52 respectively below the rearward end of upper plate 44. Apertures 62*a* and 62*b* will receive an upper axle 64 with an upper roller 66 rotatably mounted thereon.

Rollers 42 and 66 are preferably mounted on roller bearings, and have a rubber coating 42*a* and 66*a* thereon, respectively. The resiliency of the rubber coatings 42*a* and 66*a* enhance the compressive force on a chamois journaled between the rollers, to thereby more effectively remove moisture from the chamois. Simultaneously, the increased friction between the chamois and rubber prevents the chamois from "slipping" between the rollers without rotation of the rollers.

Figure 2:
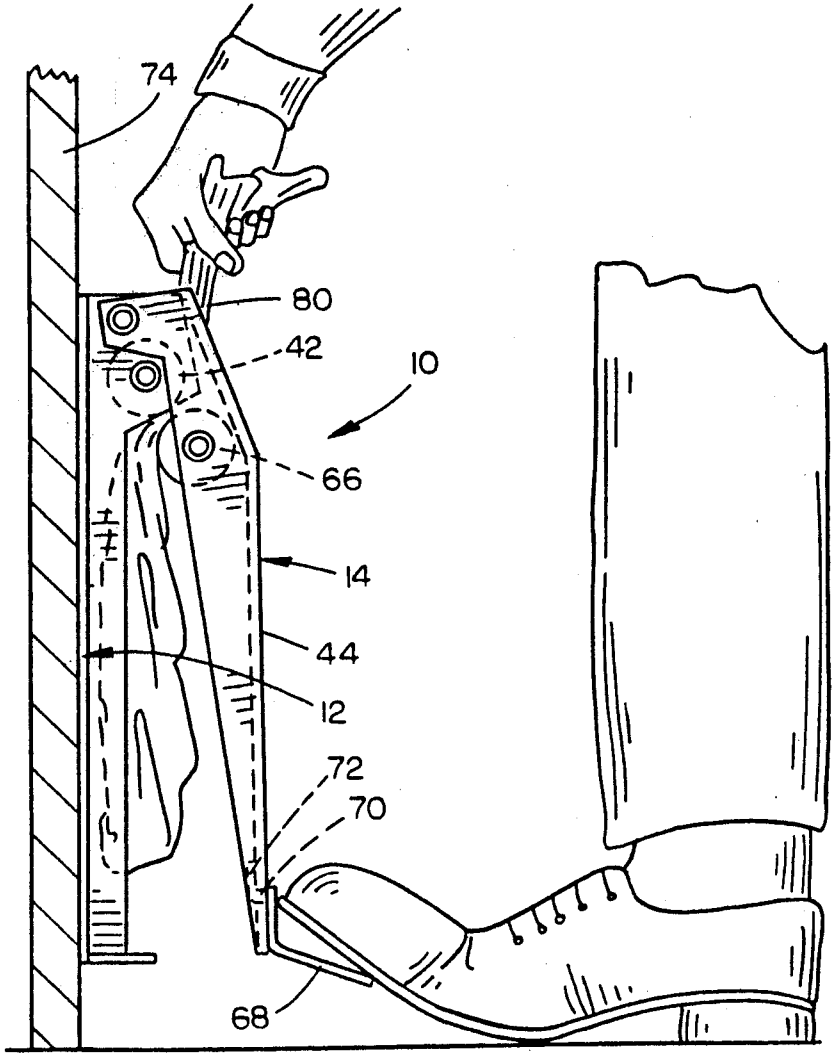
FIG. 2 is a side elevational view of the invention mounted on a wall in operating position.

A foot plate 68 may be removably connected to upper plate 44 through slot 70, located adjacent the forward end 46 of upper plate 44. Foot plate 68 is preferably an angle having a depending leg 72 which extends downwardly and rearwardly so as to be removably journaled through slot 70. When journaled in slot 70, foot plate 68 will have one leg 68*a* which projects upwardly from upper plate 44 to provide easier access by the consumer's foot to operate arm 14, as shown in FIG. 2. Foot plate 68 is particularly designed for use on chamois wringer 10 when the wringer is mounted on a wall 74, as shown in FIG. 5.

A series of keyhole apertures 74 are formed in base plate 16, as shown in FIG. 3, to receive bolts or the like for mounting chamois wringer 10 on a wall. A sheet of traction material 76 is preferably mounted on the upper surface of upper plate 44 to assist the consumer in placing pressure on arm 14 without having the foot slip off of upper plate 44. Sheet 76 is preferably sandpaper or the like mounted on upper plate 44 with adhesive.

Figure 4:
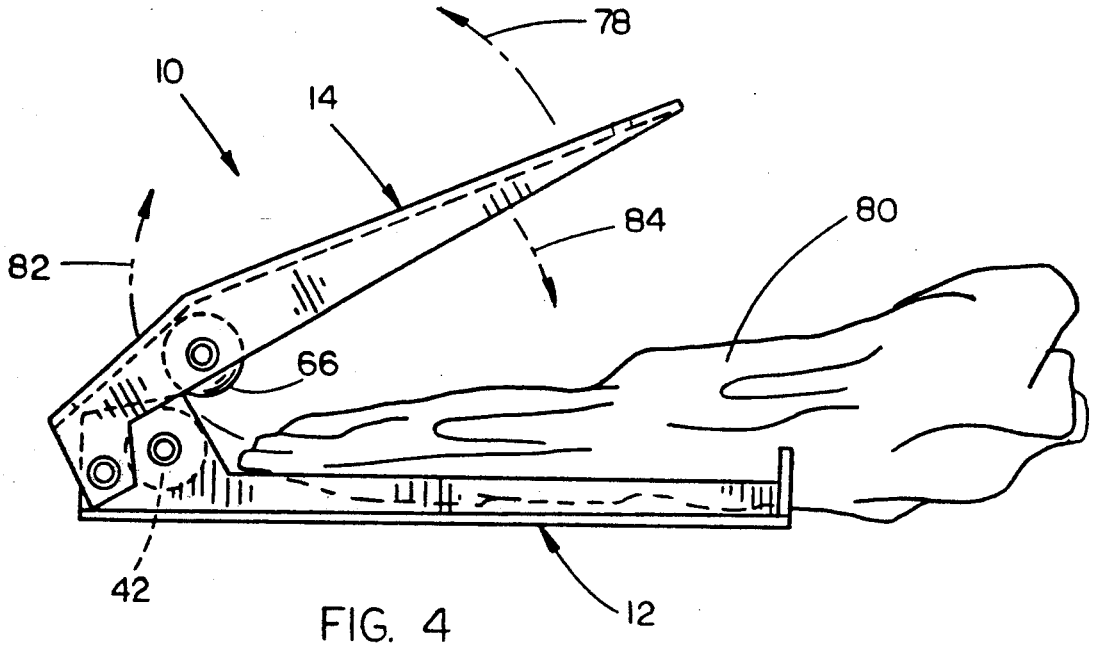
FIG. 4 is a side elevational view of the invention with a chamois being inserted therein.
Figure 5:
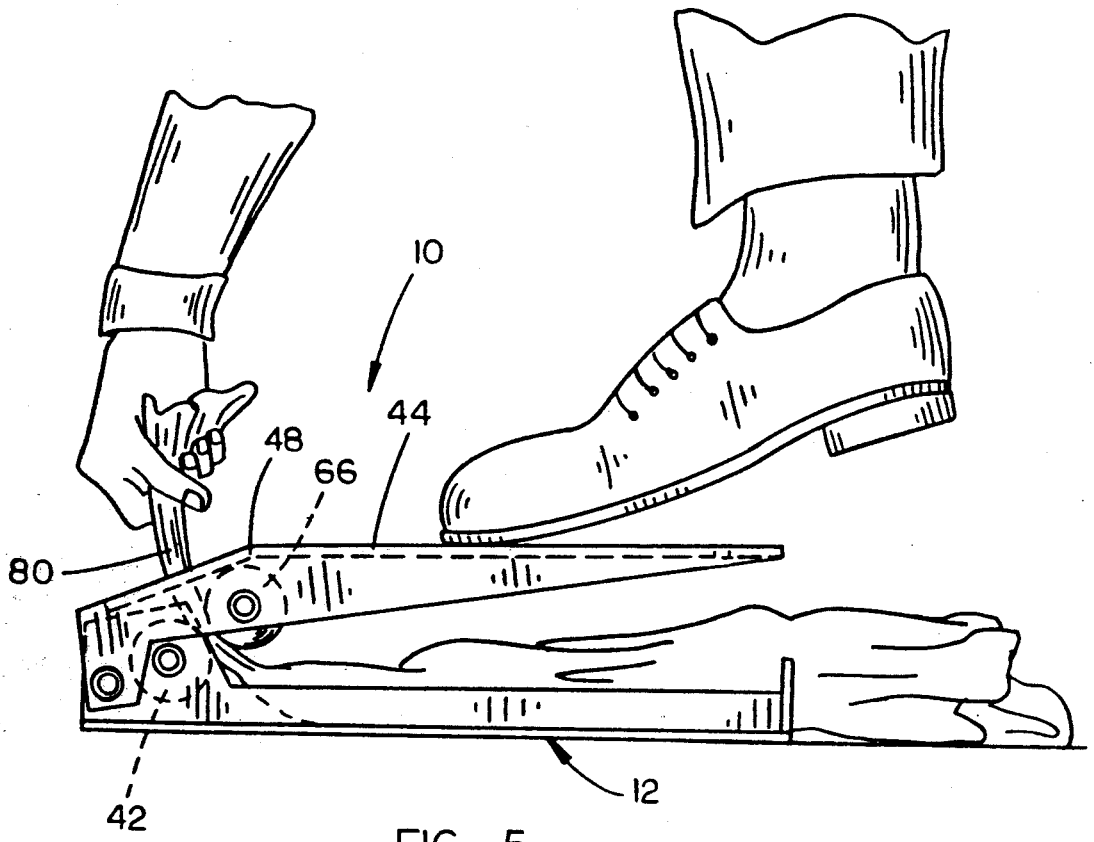
FIG. 5 is a view similar to FIG. 3 showing the invention operating to wring a chamois.

Chamois wringer 10 is designed for use in either a horizontally-oriented ground-supported position, as shown in FIGS. 4 and 5, or a vertically-oriented wall-mounted position, as shown in FIG. 2. In operation, arm 14 is pivoted upwardly away from base 12, as shown by arrow 78 in FIG. 4. This, in turn, pivots upper roller 66 away from lower roller 42 so that one end of a chamois 80 may be extended between rollers 42 and 66, as shown by arrow 82. Once chamois 80 is threaded between the rollers, arm 14 is pivoted downwardly, as shown by arrow 84, to bring rollers 42 and 66 into compressive engagement, to compress chamois 80 therebetween.

FIG. 5 shows foot pressure being applied to upper plate 44 of arm 14 to increase the compressive pressure between rollers and 66. Chamois 80 is drawn along base 12 between rollers 42 and 66 and upwardly past the rearward end 48 of upper plate 44, and removed from wringer 10.

FIG. 2 shows operation of wringer 10 in the vertical position. Foot plate 68 is preferably connected to arm 14 by journaling leg 72 through slot 70 in upper plate 44. In operation, arm 14 is again pivoted outwardly from base 12, and chamois 80 is inserted between rollers 42 and 66. Pressure is applied to foot plate 68, and thereby to arm 14, as chamois 80 is drawn upwardly between rollers 42 and 66. Water is thereby removed from chamois 80 and channeled downwardly immediately below wringer 10.

Whereas the invention has been shown and described in connection with the preferred embodiment thereof, it will be understood that many modifications, substitutions and additions may be made which are within the intended broad scope of the appended claims. There has therefore been shown and described an improved chamois wringer which accomplishes at least all of the above stated objects.

I claim:

1. A chamois wringer, comprising:

a generally flat, planar base plate having forward and rearward ends and upper and lower surfaces;

an arm having forward and rearward ends, pivotally connected at its rearward end to the rearward end of said base plate;

a first roller rotatably mounted on said base plate with the rotational axis of said first roller parallel to the pivotal access of said arm;

a second roller rotatably mounted on said arm for pivotal movement therewith;

said second roller mounted parallel to said first roller and located so as to move between an engaged position in rolling engagement with the first roller, and a disengaged position spaced away from the first roller, upon pivotal movement of said arm; and at least one foot member mounted on the forward end of said plate and projecting upwardly therefrom beyond the upper surface of said base plate, said foot member located in the pivotal path of said arm and projecting a height to prevent pivotal movement of said arm past the engaged position of said rollers.

2. The wringer of claim 1, wherein said arm includes a generally flat plannar plate having dimensions substantially the same as the base plate, said arm plate having an opening therein through which chamois may be removed from between said rollers.

3. The wringer of claim 1, further comprising a sheet of resilient flexible water resistant material mounted on the peripheral surface of said rollers.

4. The wringer of claim 2, further comprising a foot plate removably attached to said arm plate, said foot plate including:

a generally L-shaped plate having a first leg projecting upwardly from said arm plate when attached to the arm plate, and a second leg abutting the arm plate and flush thereto;

a generally L-shaped depending support leg extending downwardly from said foot plate second leg to extend through a slot in said arm plate to removably secure said foot plate to the arm plate;

said arm plate includes a generally transversely oriented slot therethrough for receiving said foot plate depending support leg.

* * * * *